US009784010B2

(12) United States Patent
Tejada et al.

(10) Patent No.: US 9,784,010 B2
(45) Date of Patent: Oct. 10, 2017

(54) MOVEABLE COVER ASSEMBLY FOR SHELTER STRUCTURES

(71) Applicant: AMERICAN RECREATION PRODUCTS, LLC, Boulder, CO (US)

(72) Inventors: Nestor Tejada, Highlands Ranch, CO (US); Erin Doubleday, Berthoud, CO (US); Kevin Gallagher, Boulder, CO (US)

(73) Assignee: Exxel Outdoors, LLC, Boulder, CO (US)

( * ) Notice: Subject to any disclaimer, the term of this patent is extended or adjusted under 35 U.S.C. 154(b) by 0 days.

(21) Appl. No.: 14/838,512

(22) Filed: Aug. 28, 2015

(65) Prior Publication Data

US 2017/0058555 A1 Mar. 2, 2017

(51) Int. Cl.

| | |
|---|---|
| ***E04H 15/16*** | (2006.01) |
| ***E04H 15/64*** | (2006.01) |
| ***E04H 15/54*** | (2006.01) |
| ***E04H 15/58*** | (2006.01) |

(52) U.S. Cl.
CPC ..... *E04H 15/64* (2013.01); *E04H 15/16* (2013.01); *E04H 15/54* (2013.01); *E04H 15/58* (2013.01)

(58) Field of Classification Search
CPC ..... E04H 15/32; E04H 15/14; E04H 15/16; E04H 15/54; E04H 15/58; E04H 15/64; E04B 7/16; E04B 9/0435
USPC ..... 135/93–94, 97, 117, 119, 115, 161; 52/63, 66, 83
See application file for complete search history.

(56) References Cited

U.S. PATENT DOCUMENTS

| | | | | |
|---|---|---|---|---|
| 1,856,658 | A * | 5/1932 | Rummler | E04H 15/00 135/117 |
| 3,515,426 | A | 6/1970 | Gerber | |
| 3,880,459 | A | 4/1975 | Kelley | |
| 4,072,158 | A * | 2/1978 | O'Brien | E04H 15/00 135/116 |
| 4,731,627 | A | 3/1988 | Chisholm | |
| 4,884,589 | A | 12/1989 | Simpson | |
| 5,019,849 | A | 5/1991 | Harrison | |
| 5,394,897 | A | 3/1995 | Ritchey et al. | |
| 5,458,146 | A | 10/1995 | Gregg | |

(Continued)

FOREIGN PATENT DOCUMENTS

| | | | |
|---|---|---|---|
| CN | 201428267 | Y | 3/2010 |
| CN | 101876215 | A | 11/2010 |

(Continued)

*Primary Examiner* — Winnie Yip
(74) *Attorney, Agent, or Firm* — Stinson Leonard Street LLP

(57) ABSTRACT

A cover assembly for use with a first window and an opposing second window is provided. The cover assembly includes a first slide fastener assembly coupled to the first window and includes a first track; a second slide fastener assembly coupled to the second window and includes a second track; and, a cover coupled to the second slide fastener assembly. The cover assembly further includes a connector coupled to the first slide fastener assembly and to the second slide fastener assembly. As the first slide fastener assembly travels along the first track, the connector is configured to move the second slide fastener assembly along the second track such that the cover moves between a first position and a second position relative to the second window.

14 Claims, 9 Drawing Sheets

(56) References Cited

U.S. PATENT DOCUMENTS

| | | | | |
|---|---|---|---|---|
| 5,765,584 | A | 6/1998 | Heisler et al. | |
| 5,819,474 | A | 10/1998 | Strom | |
| 5,820,189 | A | 10/1998 | Tew | |
| 6,216,715 | B1 * | 4/2001 | Howe | E04H 15/14 135/95 |
| 6,463,948 | B2 * | 10/2002 | Lee | E04H 15/44 135/136 |
| 6,499,497 | B1 | 12/2002 | Swetish et al. | |
| 6,679,277 | B2 * | 1/2004 | Choi | E04H 15/16 135/100 |
| 7,195,025 | B2 | 3/2007 | Choi et al. | |
| 7,261,116 | B2 * | 8/2007 | Cantwell | E04H 15/32 135/117 |
| 7,789,098 | B2 * | 9/2010 | Livacich | E04H 15/001 135/115 |
| 8,056,572 | B2 | 11/2011 | Livacich et al. | |
| 8,156,952 | B2 | 4/2012 | Chesness | |
| 8,701,688 | B2 * | 4/2014 | Vaughn | E04H 15/16 135/94 |
| 2002/0157697 | A1 * | 10/2002 | Choi | E04H 15/32 135/119 |
| 2005/0279393 | A1 * | 12/2005 | Tseng | E04H 15/16 135/94 |
| 2009/0188539 | A1 * | 7/2009 | Hollinger | E04H 15/22 135/115 |
| 2009/0301536 | A1 | 12/2009 | Cantwell | |
| 2010/0200038 | A1 | 8/2010 | Roman et al. | |
| 2011/0155198 | A1 | 6/2011 | Yang et al. | |
| 2011/0155199 | A1 | 6/2011 | Harper et al. | |

FOREIGN PATENT DOCUMENTS

| | | | |
|---|---|---|---|
| CN | 101929268 | A | 12/2010 |
| JP | 11117578 | A | 4/1990 |

* cited by examiner

MOVEABLE COVER ASSEMBLY FOR SHELTER STRUCTURES

BACKGROUND

The disclosure relates generally to cover assemblies for shelter structures, and more particularly, to covers moveable from a closed configuration to an opened configuration relative to a window of a tent structure.

Tents and various other shelters come in a variety of sizes, shapes and configurations and are used to provide portable, temporary shelter during activities such as camping or other recreational activities. Typically, tents include a fabric shell and a framework to support the shell. Shelter against precipitation is typically provided by water repellent or water-resistant material that forms the shell. However, during the appropriate weather conditions, water repellent or water-resistant material may cause condensation to collect on the inside of the tent. Such condensation causes discomfort to the occupants, dampness to clothing and gear, and a potential for growth of mildew.

In an attempt to overcome the shortcomings of such material, the use of "breathable" material, or vents made of screen or mesh may be employed. However, such configurations may have limited water repellant characteristics and are difficult to seal. Some users attach a protective, water-repellant or water-resistant covering (commonly known as a "fly") to a tent to offer additional protection from outdoor elements (e.g., rain, snow, bugs, etc.) and ventilation to its occupants. When flies are employed, the shell may include venting without having to provide water repellant seals.

Current fly configurations, however, may lack adjustability or convenience. As a result, such known fly applications are generally not well suited for situations where egress of tent to make positional adjustments to the fly is not desirable or is inconvenient. For example, a camper must exit the tent when he or she wishes to adjust the fly—a drawback when it is raining, or when insects are present. Additionally, conventional flies may require several repetitive steps to adjust a fly to a desired position. When adjustable, the flies of such tents may not be used as intended because of inconvenience and therefore the benefits of such "adjustability" are not realized by the user.

There is a need for a tent having a window and a fly with an associated cover, wherein the cover is moveable between a substantially open position and a substantially closed position relative to the window or the fly. Moreover, a need exists that provides a water repellant or water resistant protection from the elements, that allows for the interior of the tent to be ventilated, that provides the occupants with a "skylight" or window to enjoy the outdoors, that allows and encourages use and engagement of such vents and skylights, and that has an actuation interface for the fly which is operable from inside the tent in a manner that facilitates use and enjoyment.

Accordingly, it would be advantageous to have a tent with a fly having a moveable cover adapted to be substantially extended or retracted (for example, closed or opened) without the user having to exit the tent. It would also be advantageous to have a tent with a fly that includes an opening that allows for ventilation and/or viewing that may be uncovered by adjustment of the cover.

BRIEF DESCRIPTION

A cover assembly for use with a first window and an opposing second window is provided. The cover assembly includes a first slide fastener assembly coupled to the first window and includes a first track; a second slide fastener assembly coupled to the second window and includes a second track; and, a cover coupled to the second slide fastener assembly. The cover assembly further includes a connector coupled to the first slide fastener assembly and to the second slide fastener assembly. As the first slide fastener assembly travels along the first track, the connector is configured to move the second slide fastener assembly along the second track such that the cover moves between a first position and a second position relative to the second window.

In another aspect, a cover assembly for use with a tent having a first window and a fly having a second window disposed adjacent to the first window is provided. The cover assembly includes a first slide fastener assembly coupled to the first window and positioned inside the tent, the first slide fastener includes a first track; a second slide fastener assembly coupled to the second window and positioned outside of the tent, the second slide fastener includes a second track; and, a cover coupled to the second slide fastener assembly. A connector is coupled to the first slide fastener assembly and to the second slide fastener assembly. As the first slide fastener assembly travels along the first track, the connector is configured to move the second slide fastener assembly along the second track such that the cover moves between a first position and a second position relative to the second window. The cover assembly further includes a cover storage area coupled to the fly and configured to receive the cover when the cover is in the second position.

In yet another aspect, a cover assembly for use with a tent having a window and a fly that is positioned adjacent to the window is provided. The cover assembly includes a slide fastener assembly coupled to the window. The cover assembly includes a track; a first fastener portion coupled the track and positioned inside the tent; and, a second fastener portion coupled to the track and positioned outside of the tent. The cover assembly further includes a connector coupled to the fly and the second fastener portion, wherein, as the slide fastener assembly moves along the track, the connector is configured to move the fly between a first position and a second position relative to the tent.

BRIEF DESCRIPTION OF THE DRAWINGS

Features, aspects, and advantages of the present disclosure will become better understood when the following Detailed Description is read with reference to the accompanying drawings in which like characters represent like parts throughout, wherein.

DETAILED DESCRIPTION OF THE DRAWINGS

The embodiments described herein relate to a cover assembly that can easily and efficiently adapt to differing weather elements. Moreover, the embodiments relate to a fly having a cover that is moveable between a closed position and an open position while being actuated by a person who is positioned inside a shelter structure such as, but not limited to, a tent. Further, the embodiments relate a tent with a fly having a moveable cover adapted to be substantially extended or retracted (for example, closed or opened) without the user having to exit the tent. Additionally, the embodiments relate to a tent with a fly that includes an opening that allows for ventilation and/or viewing that may be uncovered by adjustment of a cover. Still further, the embodiments relate to a tent and a fly having water repellant or water resistant protection from the elements, that allows for the interior of the tent to be ventilated, that provides the occupants with a "skylight" or window to enjoy the outdoors, that allows and encourages use and engagement of such vents and skylights, and that has an actuation interface for a cover which is operable from inside the tent. It should be understood that the descriptions and figures that utilize a tent as the shelter structure are exemplary only. The exemplary cover assembly can be used with other structures such as, but not limited to, shades and screen houses.

Figure 1:
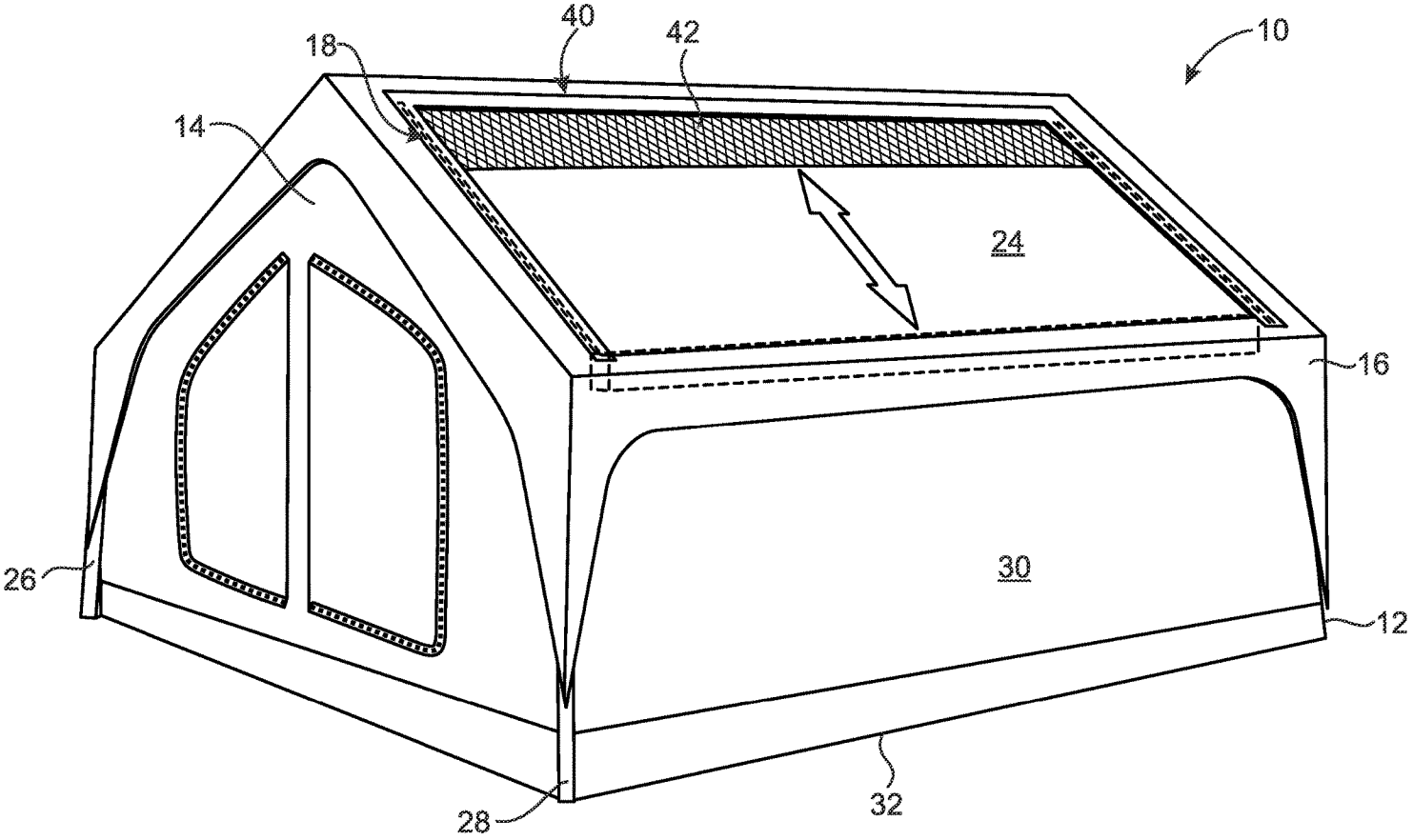
FIG. 1 is a perspective view of a tent, a fly, and an exemplary cover assembly coupled to the tent and to the fly.
Figure 2:
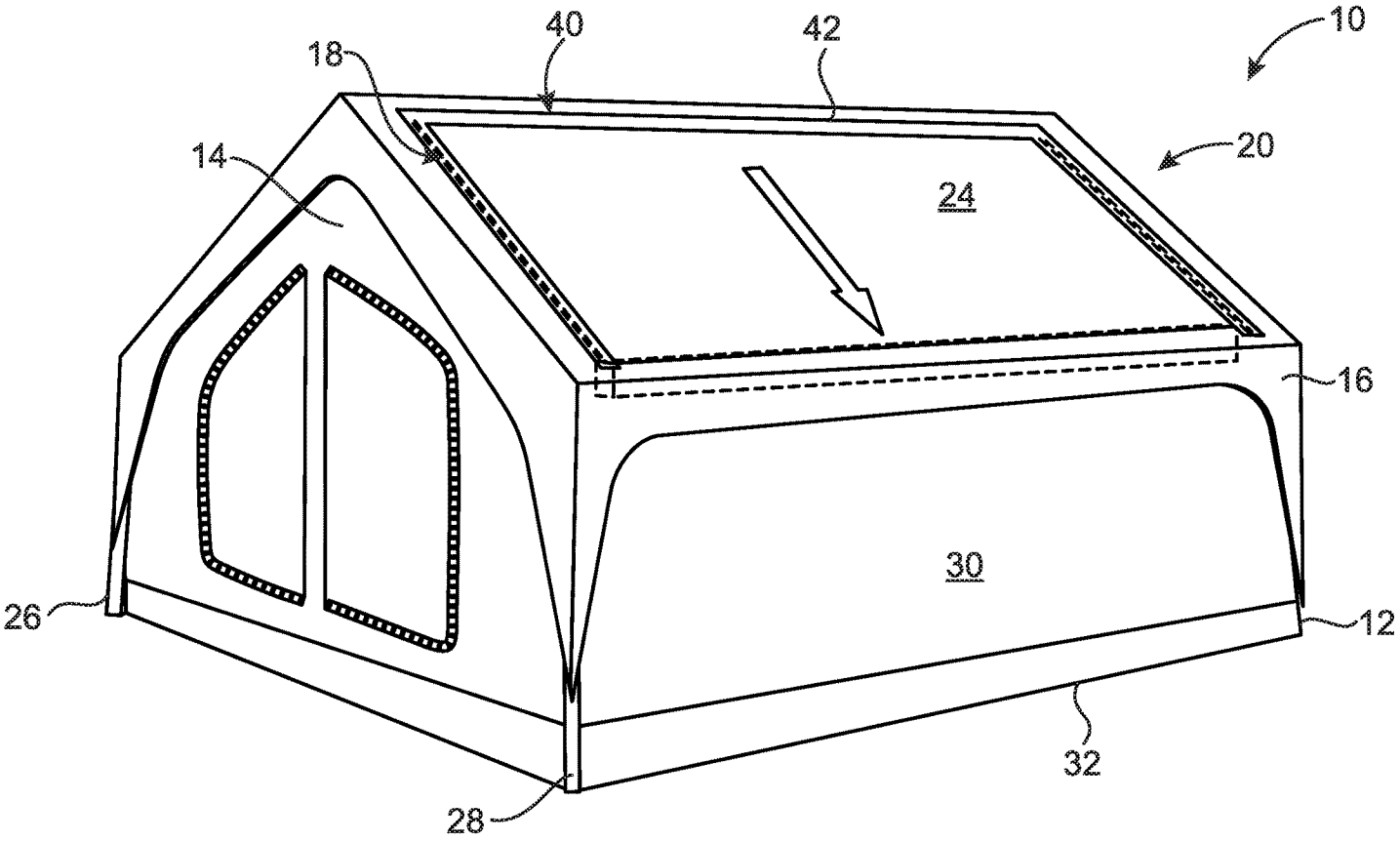
FIG. 2 is a perspective view of the tent and fly of FIG. 1 and the cover assembly in a closed position.
Figure 3:
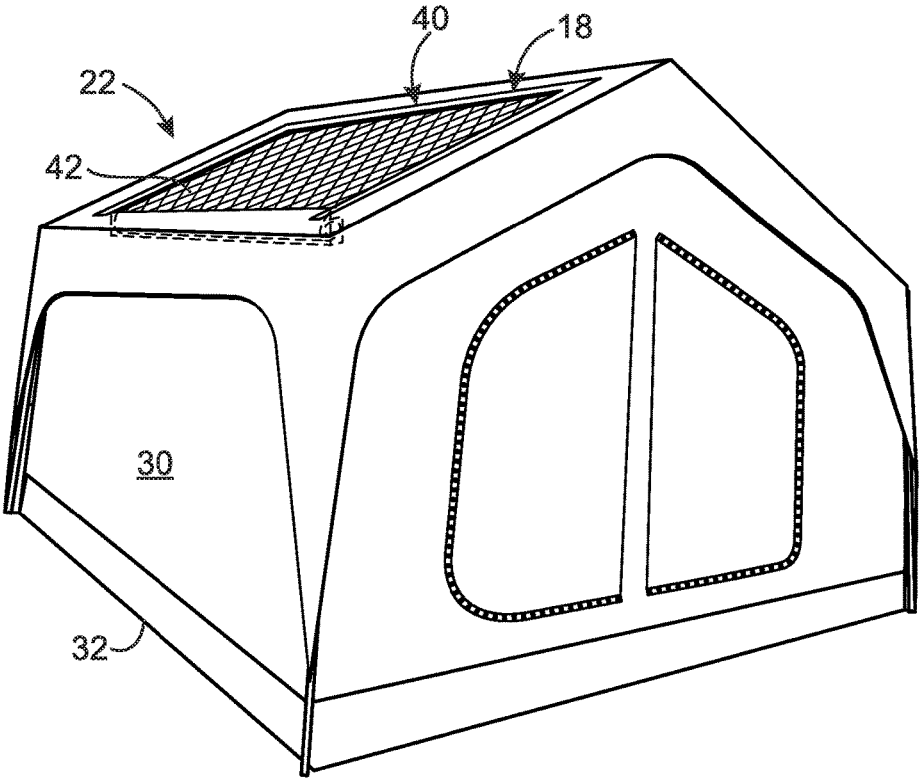
FIG. 3 is a perspective view of the tent and fly of FIG. 1 and the cover assembly in an open position.

FIG. 1 is a perspective view of a tent 10 having a frame 12 supporting a shell 14. FIG. 1 illustrates an overlying covering or sheet shown as a fly 16 and illustrates a cover assembly 18 coupled to the tent 10 and to the fly 16. FIG. 2 is a perspective view of the tent 10, the fly 16, and the cover assembly 18 in a first position 20 such as, for example only, a closed position. FIG. 3 is a perspective view of the tent 10, the fly 16, and the cover assembly 18 in a second position 22 such as, for example only, an open position. The cover assembly 18 includes a cover 24 that is selectively and reciprocally moveable between the first position 20 and the second position 22 relative to the tent 10. More particularly, the cover assembly 18 is configured to be selectively adjusted by a person/occupant (not shown) "inside" of shell 14. "Inside" of shell 14 is intended to mean that the person is substantially inside of the shell 14 and encompasses alternative embodiments wherein the person extends a portion of his or her body (for example, hand, arm, etc.) outside of the shell to selectively adjust the cover assembly 18. Selective adjustment of the cover assembly 18 may take many of a variety of forms, including pivoting, sliding, rolling, "bunching," stretching, etc. Shell 14 may include frame poles 26 which can include a plurality of substantially straight sections and/or curved sections, wherein the sections can be fixed or bendable. According to alternative embodiments, poles 26 may have various shapes depending upon the desired shape and size of the tent and may be made from a variety of materials (e.g., plastic, metal bands, etc.) designed to provide the desired characteristics.

The shell 14 defines a space for users to occupy and store gear (not shown). Shell 14 is formed by a plurality of flexible fabric panels or sheets connected by seams which together comprise walls 30, a floor 32, and a roof 34. Walls 32 preferably include multiple layers of material for selective arrangement for privacy and/or ventilation. Walls 30 include at least one of a first window 36 and a vent 38 formed by a netting or a screen that can be made from material that has any of a variety of degrees of light transmission (for example, between opaque and transparent). Either or both of the first window 36 and vent 38 may be provided with a closure mechanism (not shown), for example, a zipper, or a latch-hook fastener which may be selectively opened from inside and/or outside tent 10. In the exemplary embodiment, the walls 30, floor 32, and roof 40 are made from water repellant or water resistant material. Alternatively, portions of the walls 30, the floor 32, or the roof 40 may be formed from "breathable" material (for example, material having a lesser degree of water resistance). Shell 14 can also include one or more first windows 36 positioned through the roof 40 to provide a variety of functions (for example, ventilate air, to provide a "window" or "skylight," etc.).

In the exemplary embodiment, the fly 16 includes at least one of a second window 42. The second window 42 can also include the vent 38 made from a material that has any of a variety of degrees of light transmission (for example, between opaque and transparent). In an assembled position, the first window 36 and the second window 42 are aligned and spaced apart from each other. The cover assembly 18 is configured to selectively move the cover 24 relative to the first window 36 and the second window 42. More particularly, the cover assembly 18 is configured to selectively move the cover 24 between the first position 20, for example, the closed position shown in FIG. 2, and the second position 22, for example, the open position shown in FIG. 3. In the exemplary embodiment, the cover assembly 18 is actuated by a person positioned inside of the tent 10 or at least partially positioned inside the tent 10.

Figure 4:
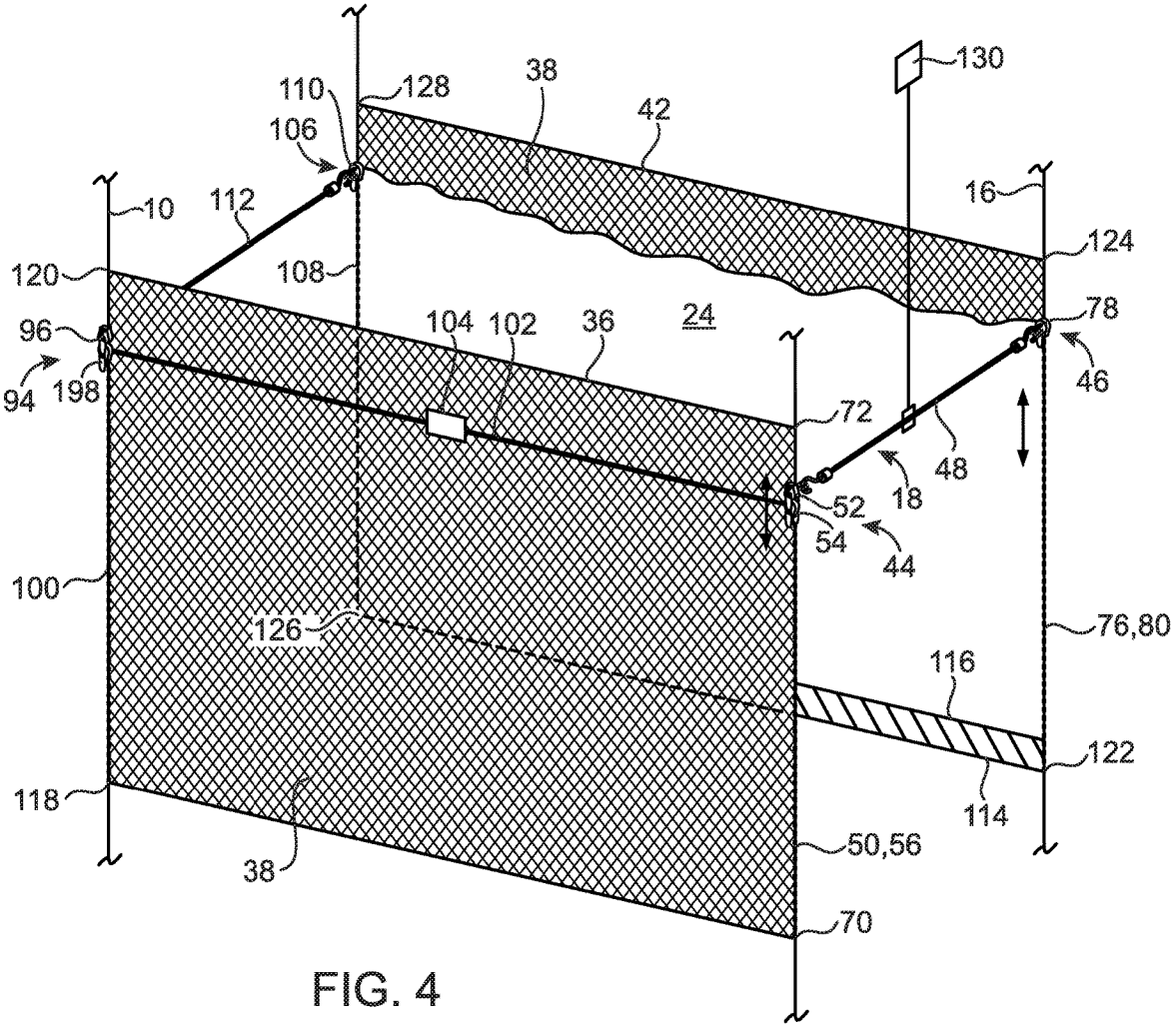
FIG. 4 is a perspective view of a first window of the tent, a second window of the fly, and the cover assembly coupled to the first window and a cover of the fly.
Figure 4A:
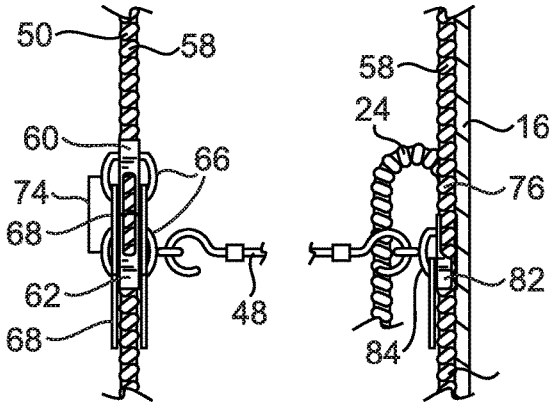
FIG. 4A is a partial detail view of the cover assembly of FIG. 4.
Figure 5:
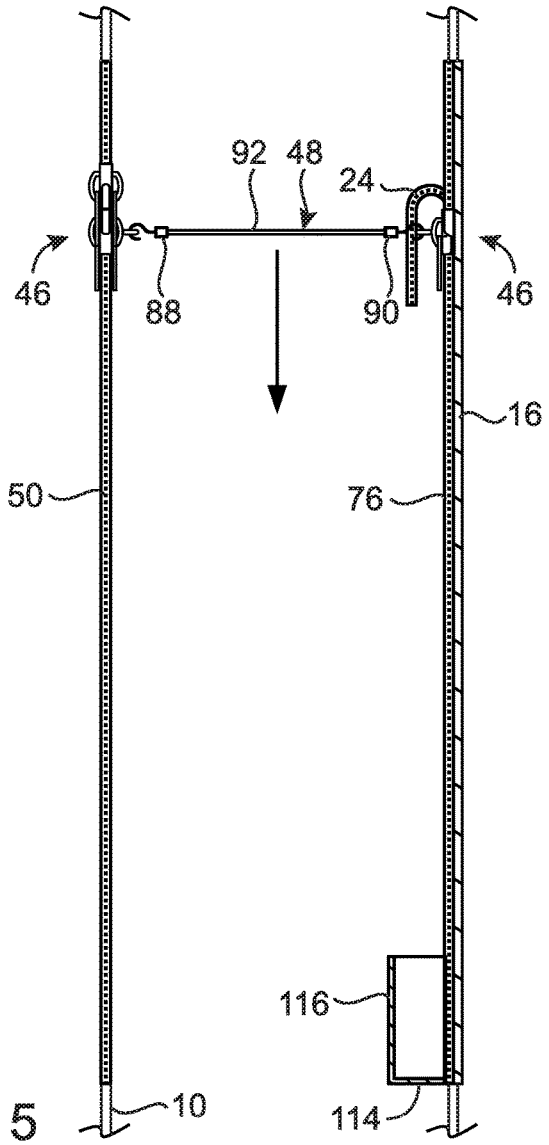
FIG. 5 is a side view of the cover assembly and the cover.

FIG. 4 is a perspective view of the first window 36 of the tent 10, the second window 42 of the fly 16, and the cover assembly 18 which is coupled to the first window 36 and the cover of the fly 16. FIG. 4A is a detail view of the cover assembly 18. FIG. 5 is a side view of the cover assembly 18 and the cover 24. The cover assembly 18 further includes a first slide fastener assembly 44, a second slide fastener assembly 46, and a connector 48. The first slide fastener assembly 44 is coupled to the first window 36 and/or to the tent 10. Alternatively, the first slide fastener assembly 44 can couple to any portion of the tent 10 to enable movement of the cover 24 while the person remains positioned inside the tent 10. The first slide fastener assembly 44 includes a first track 50, a first fastener 52, and a second fastener 54. In the exemplary embodiment, the first track 50 includes a zipper track 56 having opposing teeth 58. The first fastener 52 includes a first zipper 60 and the second fastener 54 includes a second zipper 62. Alternatively, the first slide fastener assembly 44 can include other configurations such as, but not limited to, a hook and loop fastener. Each first fastener 52 and second fastener 54 includes clasp portions which include an inner clasp portion 64 that is positioned on an inner side of the first track 50 and inside the tent 10. Moreover, each first fastener 52 and second fastener 54 includes clasp portions which include an outer clasp portion 66 that is positioned on an outer side of the first track 50 and outside of the tent 10. Pull tabs 68 can couple to the portions 64, 66.

The first fastener 52 and the second fastener 54 operatively couple to the first track 50. In the exemplary embodiment, the first fastener 52 and second fastener 54 are oppositely arranged on the first track 50 such that the first fastener 52 and second fastener 54 can adjacently travel along the first track 50 to maintain the first track 50 in fastened or closed position. More particularly, when the first zipper 60 moves from a track end 70 and to another track end 72, the first zipper 60 is configured to separate and open the zipper teeth 58. As the first zipper 60 moves from the track end 72 and to the other track end 70, the first zipper 60 is configured to mate and close the zipper teeth 58. Conversely, as the second zipper 62 moves from the track end 70 and to the other track end 72, the second zipper 62 is configured to mate and close the zipper teeth 58. Moreover, as the second zipper 62 moves from the track end 72 and to the other track end 70, the second zipper 62 is configured to separate and open the zipper teeth 58. Accordingly, when the first zipper 60 and the second zipper 62 travel along the zipper track 56 adjacent to each other, the zipper track 56 remains in the closed or fastened position. More particularly, as the first zipper 60 and second zipper 62 move from track end 70 to the other track end 72, the first zipper 60 opens the zipper teeth 58 and the second zipper 62 immediately closes the zipper teeth 58. Alternatively, as the first zipper 60 and second zipper 62 move from the track end 72 to the other track end 70, the second zipper 62 opens the zipper teeth 58 and the first zipper 60 immediately closes the zipper teeth 58. In an embodiment, a common fastener 74 can couple to the first zipper 60 and to the second zipper 62. The common fastener 74 is configured to be handled by the person and move the first zipper 60 and the second zipper 62 together at the same time along the first track 50.

In the exemplary embodiment, the second slide fastener assembly 46 is coupled to the second window 42 and/or to the tent 10. Alternatively, the second slide fastener assembly 46 can couple to any portion of the fly 16 to enable movement of the cover 24 while the person remains inside or partially inside the tent 10. The second slide fastener assembly 46 includes a second track 76 and a third fastener 78. The second track 76 includes a zipper track 80 having opposing teeth 58. The third fastener 78 includes a third zipper 82. Alternatively, the second fastener 54 can include other configurations such as, but not limited to, a hook and loop fastener. The third zipper 82 includes an inner clasp portion 84 that is positioned on an inner side of the fly 16 and another outer clasp portion 86 positioned on an outer side of the fly 16. The pull tab 68 is coupled to at least one of the inner clasp 66 and the outer clasp portion 86. The third zipper 82 is coupled to the zipper track 80 and configured to reciprocally move along the zipper teeth 58 of the zipper track 80.

In the exemplary embodiment, the cover 24 is coupled to the second slide fastener assembly 46. The cover 24 includes a curtain, a shade, and/or a blind which is configured to overlay the second window 42. Alternatively, the cover 24 can include other configurations to at least partially block the second window 42. More, particularly, the cover 24 is configured to block weather elements such as rain or dew from passing through the fly 16 via the second window 42. The cover 24 can also block or partially block sunlight from passing through the fly 16 via the second window 42. Moreover, the cover 24 can be made from material that has any of a variety of degrees of light transmission (for example, between opaque and transparent).

The connector 48 is coupled to the first slide fastener assembly 44 and to the second slide fastener assembly 46. In particular, the connector 48 is coupled to at least one of the outer clasp portions 66 of the first zipper 60 and second zipper 62. Moreover, the connector 48 is coupled to the inner clasp portion 84 of the third zipper 82. In an embodiment, the connector 48 can removably couple to clasp portions 66, 84. In the exemplary embodiment, the connector 48 includes a cord such as a bungee cord. Alternatively, the connector 48 can include other configurations such as, for example only, a flexible rod, a pole, and/or a magnetic assembly. The connector 48 can include any configuration to couple together the first slide fastener assembly 44 and the second slide fastener assembly 46. In one embodiment, the connector 48 includes a first end 88 coupled to the first fastener 52, a second end 90 coupled to the third fastener 78, and a body 92 located between the first end 88 and the second end 90. The body 92 can be expandable such as a flexible cord or telescoping rod to accommodate different spacing between the tent 10 and the fly 16.

On an opposite side of the first window 36, the cover assembly 18 includes a third slide fastener assembly 94 which mirrors the first slide fastener assembly 44. More particularly, the cover assembly 18 includes the third slide fastener assembly 94 having a fourth fastener 96 and a fifth fastener 98 assembly coupled to a third track 100. In an embodiment, a common fastener or connector 102 can couple to the first slide fastener assembly 44 and the third slide fastener assembly 94. The common connector 102 can further include a handle 104 for simultaneous operation of the first slide fastener assembly 44 and the third slide fastener assembly 94 by the person who is positioned or partially positioned within the tent 10. Moreover, the cover assembly 18 includes a fourth slide fastener assembly 106 coupled to a fourth track 108, which is coupled to another side of the second window 42. The fourth slide fastener assembly 106 includes a sixth fastener 110 movably coupled to the fourth track 108. Moreover, the cover 24 is coupled to the fourth slide fastener assembly 106. The fasteners 96, 98 and fastener 110 are configured to move relative to the respective third track 100 and fourth track 108 as previously described for fasteners 52, 54, and fastener 78. Additionally, a connector 112 is removably coupled to the third slide fastener assembly 94 and the fourth slide fastener assembly 106. The connector 112 is configured to move the fourth slide fastener assembly 106 in response to movement of the third slide fastener assembly 94.

The cover assembly 18 further includes a cover storage area 114 coupled to the fly 16. The cover storage area 114 includes a pocket or sleeve that is attached such as, for example only, sewn or glued, to the fly 16 and near a lower portion of the second window 42. In the exemplary embodiment, the cover storage area 114 is sized and shaped to receive the cover 24 when the cover 24 is in the second position 22. A cover seal 116 such as a slide fastener, and hook and loop fastener, or buckles can close the cover storage area 114 against the inner side of the fly 16 to facilitate storing the cover 24 that has been moved to the second position 22.

During an exemplary operation, the person erects the fly 16 next to the tent 10, wherein the person can align the second window 42 with the first window 36. The connector 48 is coupled to the first slide fastener assembly 44 and the second slide fastener assembly 46. More particularly, the person removably couples the connector 48 to at least one of the clasp portions 66 and to the clasp portion 84 to position the connector 48 between the first window 36 and second window 42. The other connector 112 is also coupled to the third slide fastener assembly 94 and the fourth slide fastener assembly 106 to position the connector 102 between the first window 36 and the second window 42.

While positioned within the tent 10, the person can move the first slide fastener assembly 44 along the first track 50 from track end 70 to track end 72. The person can also move the third slide fastener assembly 94 along the third track 100 from a track end 118 to a track end 120. Alternatively, the person can move the common connector 102 coupled to the first slide fastener assembly 44 and the third slide fastener assembly 94 to move the first slide fastener assembly 44 and the third slide fastener assembly 94 together along the respective first track 50 and the third track 100. The movement of the first fastener 52 and the second fastener 54 maintains the first track 50 in the fastened position while the movement of the fourth fastener 96 and the fifth fastener 98 maintains the third track 100 in the fastened position. Accordingly, the first window 36 does not decouple or fall out from the tent 10 as the slide fastener assemblies 44, 94 move along the respective tracks 50, 100.

As the first slide fastener assembly 44 travels along the first track 50 from track end 70 to track end 72, the connector 48 moves the second slide fastener assembly 46 along the second track 76 from track end 122 to track end 124. Moreover, as the third slide fastener assembly 94 moves along the third track 100, the connector 112 moves the fourth slide fastener assembly 106 along the fourth track 108 from track end 126 to track end 128. Since the cover 24 is coupled to the second slide fastener assembly 46 and the fourth slide fastener assembly 106, the cover 24 moves with the respective second slide fastener assembly 46 and the fourth slide fastener assembly 106 to the first position 20 relative to the second window 42. In the first position 20, the cover 24 at least partially overlays the second window 42 to block or at least partially block weather elements such as, for example only, rain and sunshine from passing through the second window 42 and into the first window 36.

Moreover, while still positioned within the tent 10, the person can move the first slide fastener assembly 44 along the first track 50 from track end 72 to track end 70. The person can also move the third slide fastener assembly 94 along third track 100 from track end 120 to the track end 118. Alternatively, the person can move the common connector 102 coupled to the first slide fastener assembly 44 and the third slide fastener assembly 94 along the respective first track 50 and third track 100 toward ends 70, 126. As the first fastener 52 and the second fastener 54 adjacently travel along the first track 50 and the fourth fastener 96 and the fifth fastener 98 adjacently travel along the third track 100, the fasteners 52, 54, 96, 98 are configured to respectively maintain the first track 50 and the third track 100 in the fastened positions. Accordingly, the first window 36 does not decouple or fall out from the tent 10 as the slide fastener assemblies 44, 94 move along the respective tracks 50, 100 from track ends 72, 70 to track ends 120, 118.

As the first slide fastener assembly 44 travels along the first track 50 from track end 72 to track end 70, the connector 48 moves the second slide fastener assembly 46 along the second track 76 from track end 124 to track end 122. Moreover, as the third slide fastener assembly 94 moves along the third track 100 from track end 120 to track end 118, the connector 112 moves the fourth slide fastener assembly 106 from track end 128 to track end 126. Since the cover 48 is coupled to the second slide fastener assembly 46 and the fourth slide fastener assembly 106, the cover 48 moves with the respective second slide fastener assembly 46 and the fourth slide fastener assembly 106 to the second positon 22 relative to the second window 42. In the second position 22, the cover 48 exposes or at least partially exposes the second window 42 to allow or at least partially allow sunlight through the second window 42 and into the first window 36 and/or ventilate the tent 10 through the first window 36. Moreover, as the cover 48 moves to the second position 22, the cover 24 rolls, falls, or moves into the cover storage area 114. The person can operate the cover seal 46 to seal the cover storage area 114 to store and protect the cover 24 therein.

In an alternative use, the person can couple a reel mechanism 130 of the cover assembly 18 to the cover assembly 18. More particularly, the person can couple the reel mechanism 130 to at least one of the connector 48, the connector 112, and clasp portions 84, 86. The person can actuate the reel mechanism 130 to move the connector 48, the connector 112, and/or clasp portions 84, 86 to facilitate moving the cover 24 relative to the second window 42. Moreover, in another use, the person can stand at least partially outside of the tent 10 and decouple the connector 48 from the first slide fastener assembly 44 and decouple the connector 48 from the third slide fastener assembly 94. The person can move the clasp portions 86 positioned on the fly 16 to move the second slide fastener assembly 46 and the fourth slide fastener assembly 106 relative to the second and fourth tracks 76, 108 to selectively and reciprocally move the cover 24 relative to the second window 42.

Figure 6:
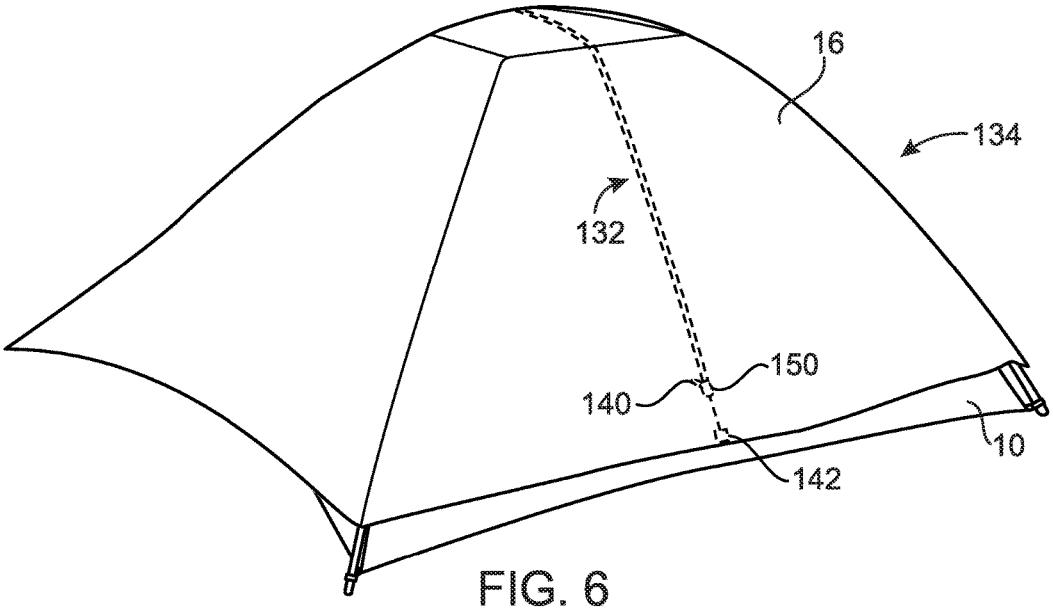
FIG. 6 is a perspective view of a tent, a fly, and another exemplary cover assembly coupled to the tent and the fly with the fly shown in a closed position.
Figure 7:
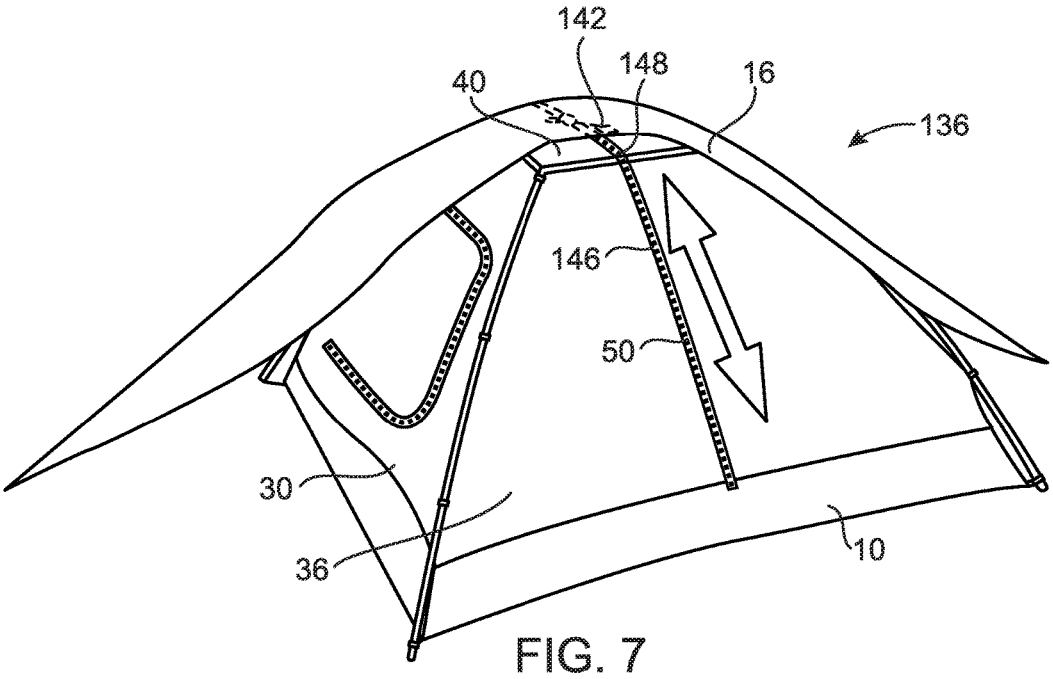
FIG. 7 is a perspective view of the tent, the fly, and the cover assembly of FIG. 6 with the fly in a partially opened position.
Figure 8:
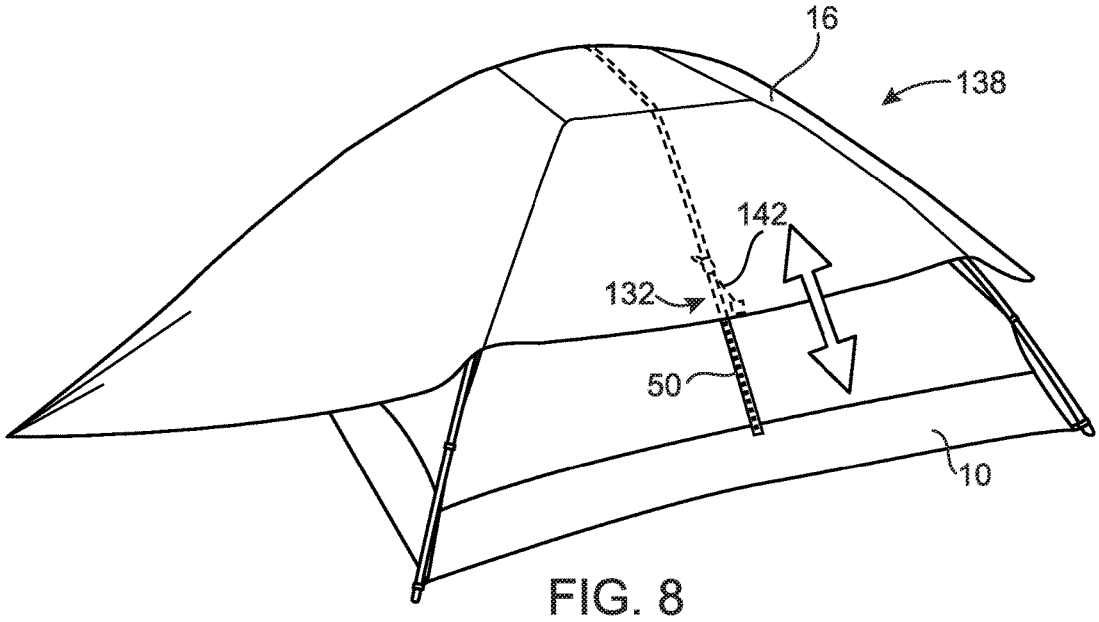
FIG. 8 is a perspective view of the tent, the fly, and the cover assembly of FIG. 6 with the fly in an open position.
Figure 8A:
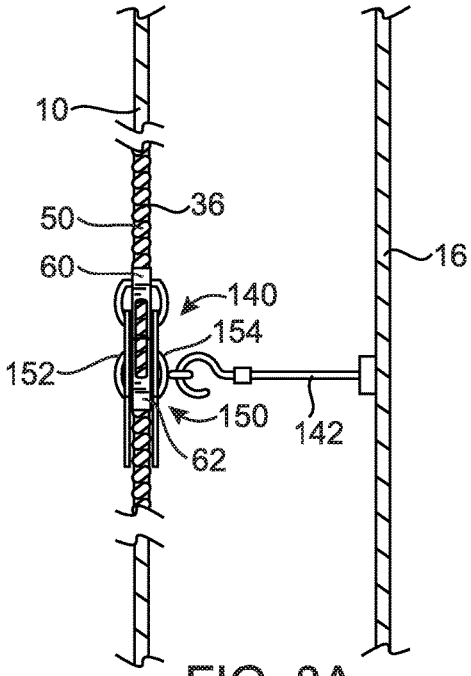
FIG. 8A is a partial detail view of the cover assembly of FIG. 6.

FIG. 6 is a perspective view of the tent 10, the fly 16, and a cover assembly 132 coupled to the tent 10 and to the fly 16. The fly 16 is shown in the first position 134 such as, for example, a closed position. FIG. 7 is another perspective view of the tent 10, the fly 16, and the cover assembly 132 coupled to the tent 10 and to the fly 16. The fly 16 is shown in a second position 136 such as, for example, a partially opened position. FIG. 8 is another perspective view of the tent 10, the fly 16, and the cover assembly 134 coupled to the tent 10 and to the fly 16. The fly 16 is shown in a third position 138 such as, for example, an opened position. FIG. 8A is a detail view of the cover assembly 132. In FIGS. 6-8A, similar components a shown in FIGS. 1-5 include the same element numbers as shown in FIGS. 1-5. In the exemplary embodiment, the tent 10 includes a dome configuration wherein the window 36 can include covering at least one of the walls 30 and the roof 40. Alternatively, the tent 10 and the window 36 can include any configuration for positioning the window 36.

The cover assembly 132 includes a slide fastener assembly 140 coupled to the tent 10. The cover assembly 132 further includes a connector 142 coupled to the slide fastener assembly 140 and to the fly 16. The slide fastener assembly 140 includes the track 50 such as, for example only, the zipper track coupled to the window 36. In the exemplary embodiment, the track 50 runs along the window 36 relative to the wall 30 and the top roof 40. The track 50 can include at least one straight path 146 and a curved path 148. More particularly, the track 50 includes the straight path 146 along the wall 30 and the roof 40, while positioning the curved path 148 at the intersection of the wall 30 and the roof 40.

The slide fastener assembly 140 includes a fastener 150 having the first zipper 60 and the second zipper 62 coupled to the zipper track 50. The first zipper 60 and the second zipper 62 are configured to adjacently travel along the zipper track 50 to facilitate maintaining the zipper track 50 in the closed or fastened position. The fastener 150 further includes a first fastener portion 152 coupled to the track 50 and positioned inside of the tent 10. Moreover, the fastener 150 includes a second fastener portion 154 coupled to the track 50 and positioned outside of the tent 10. In the exemplary embodiment, the connector 142 is coupled to the fly 16 and the second fastener portion 154. During an exemplary use, as the slide fastener assembly 140 moves along the track 50, the connector 142 is configured to reciprocally move the fly 16 from the first position 134, through the second position 136, and to the third position 138. More particularly, during use, the person remains inside of the tent 10 while selectively and reciprocally moving the slide fastener assembly 140 to move the fly 16 relative to the tent 10.

Figure 9:
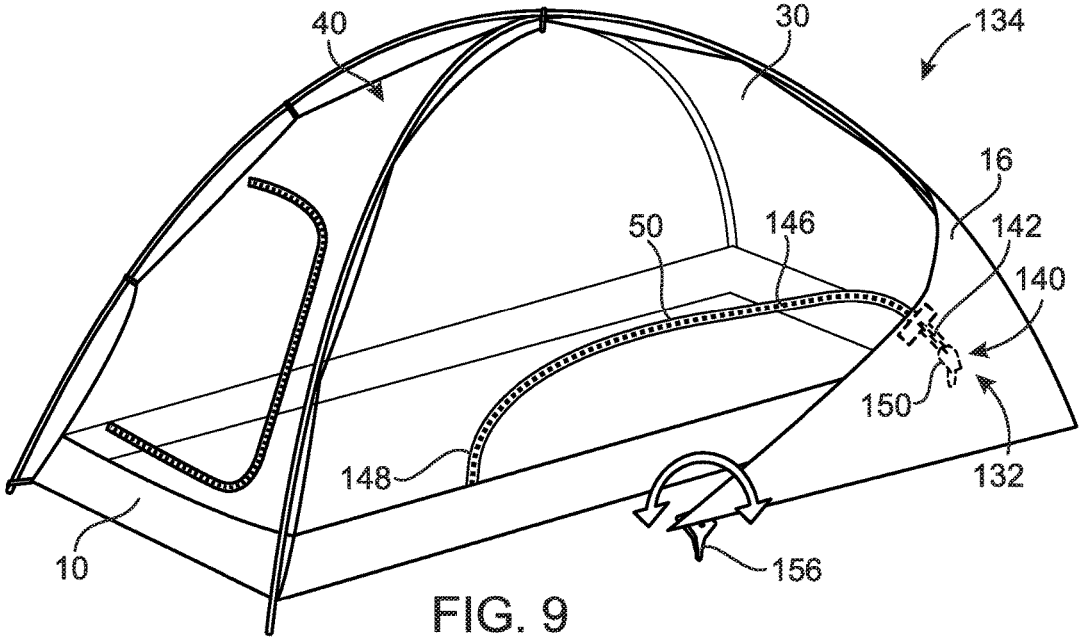
FIG. 9 is a perspective view of a tent, a fly, and another exemplary cover assembly coupled to the tent and the fly with the fly shown in an open position.
Figure 10:
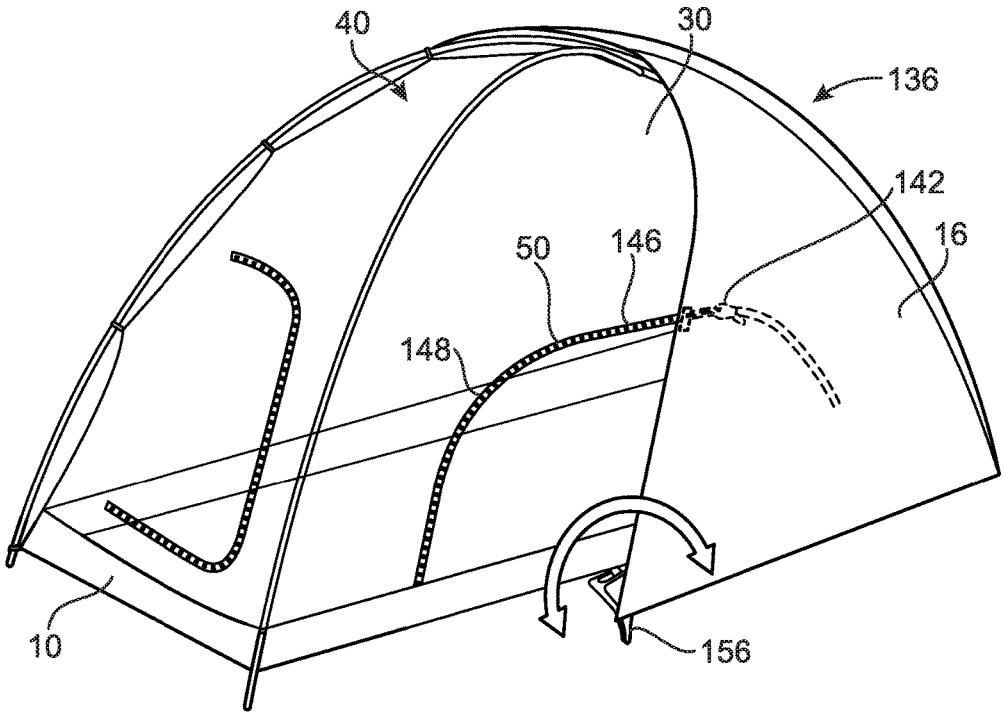
FIG. 10 is a perspective view of the tent, the fly, and the cover assembly of FIG. 9 with the fly in a partially opened position.
Figure 11:
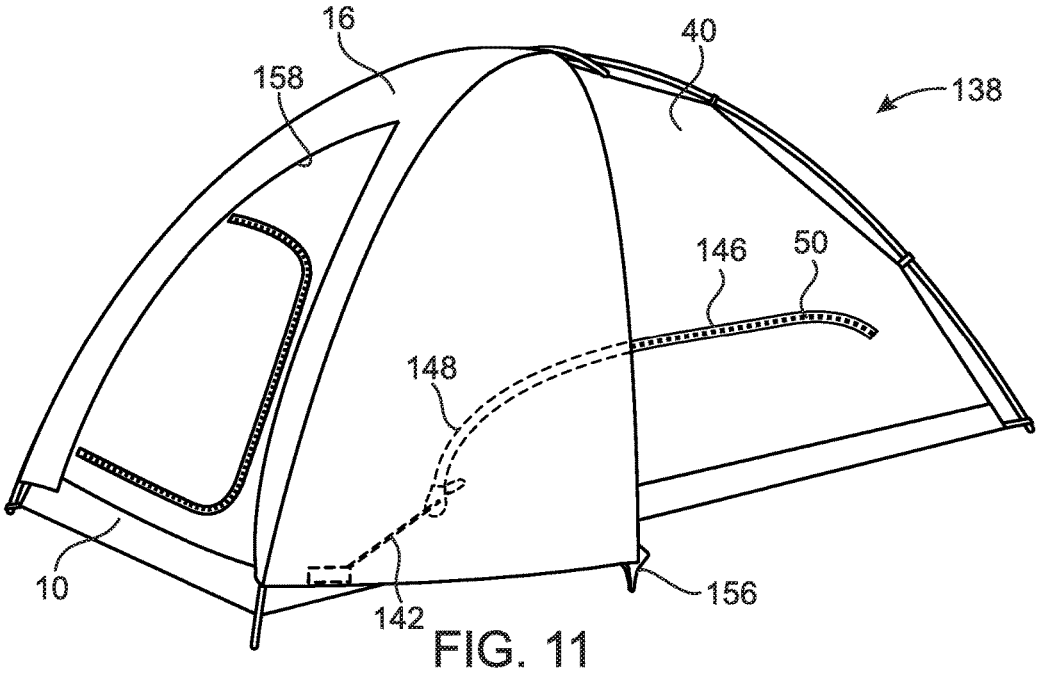
FIG. 11 is a perspective view of the tent, the fly, and the cover assembly of FIG. 9 with the fly in a closed position.
Figure 12:
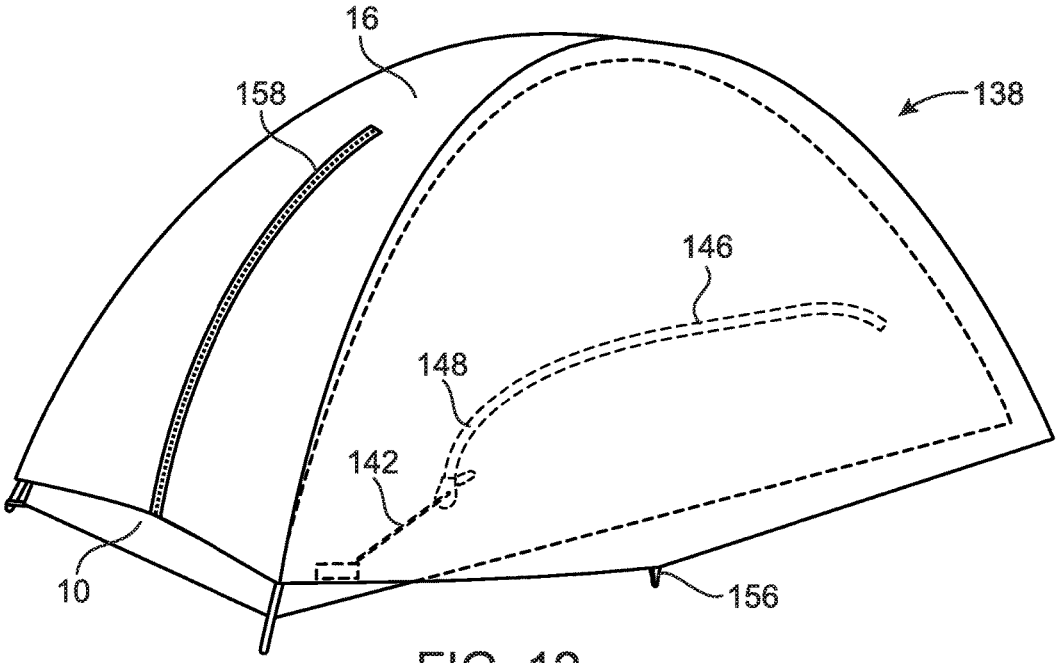
FIG. 12 is a perspective view of the tent, the fly, and the cover assembly of FIG. 9 with the fly in another closed position.

FIG. 9 is a perspective view of the tent 10, the fly 16, and the cover assembly 132 coupled to the tent 10 and to the fly 16. The fly 16 is shown in the first position 134 such as, for example, an open position. FIG. 10 is another perspective view of the tent 10, the fly 16, and the cover assembly 132 coupled to the tent 10 and to the fly 16. The fly 16 is shown in the second position 136 such as, for example, a partially opened position. FIG. 11 is another perspective view of the tent 10, the fly 16, and the cover assembly 132 coupled to the tent 10 and to the fly 16. The fly 16 is shown in the third position 138 such as, for example, a closed position. FIG. 12 is another perspective view of the tent 10, the fly 16, and the cover assembly 132 coupled to the tent 10 and to the fly 16. The fly 16 is shown in a closed position relative to a tent door. In FIGS. 9-12, similar components a shown in FIGS. 1-8A include the same element numbers as shown in FIGS. 1-8A. In the exemplary embodiment, the tent 10 includes a dome configuration wherein the window 36 can include covering at least one of the walls 30 and the roof 40. Alternatively, the tent 10 and the window 36 can include any configuration for positioning the window 36.

The cover assembly 132 includes the slide fastener assembly 140 coupled to the tent 10. Additionally, the cover assembly 132 further includes the connector 142 coupled to the slide fastener assembly 140 and to the fly 16. The slide fastener assembly 140 includes the track 50 such as, for example only, the zipper track coupled to the window 36. In the exemplary embodiment, the track 50 runs along the window 36 relative to the wall 30 and the roof 40. The track 50 can include at least one of the straight path 146 and the curved path 148. More particularly, the track 50 includes the straight path 146 along a horizontal section of the wall 30, and the curved path 148 along a vertical section of the wall 30.

The slide fastener assembly 140 includes the fastener 150 having the first zipper 60 and the second zipper 62 (both shown in FIG. 8A) coupled to the track 50. The first zipper 60 and the second zipper 62 are configured to adjacently travel along the track 50 to facilitate maintaining the track 50 in the closed or fastened position. The fastener 150 further includes the first fastener portion 152 (shown in FIG. 8A) coupled to the track 50 and positioned inside of the tent 10. Moreover, the fastener 150 includes the second fastener portion 154 (shown in FIG. 8A) coupled to the track 50 and positioned outside of the tent 10. In the exemplary embodiment, the connector 142 is coupled to the fly 16 and the second fastener portion 154. During an exemplary use, as the slide fastener assembly 140 moves along the track 50, the connector 142 is configured to reciprocally move the fly 16 from the first position 134, through the second position 136, and to the third position 138. More particularly, during use, the person remains inside of the tent 10 while selectively and reciprocally moving the slide fastener assembly 140 to move the fly 16 relative to the tent 10. The cover assembly 18 further includes a pivot mechanism 156 coupled to the fly 16. The pivot mechanism 156 is configured to facilitate the reciprocal movement of the fly 16 through the first position 134, the second position 136, and the third position 138. The pivot mechanism 156 can include a rotatable shaft inserted into the ground (not shown) to stabilize the rotational movement of the fly 16. In the exemplary embodiment, the fly 16 includes an opening 158 for exposing the tent door or covering the tent door.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

Exemplary embodiments of a cover assembly are described herein. The methods and assemblies are not limited to the specific embodiments described herein, but rather, components of assemblies and/or steps of the methods may be utilized independently and separately from other components and/or steps described herein. For example, the methods may also be used in combination with other assemblies and methods, and are not limited to practice with only the assemblies and methods described herein. Rather, the exemplary embodiments may be implemented and utilized in connection with many other shelter structures such as, for example only, shade houses and screen houses, and containers.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using devices or assemblies or systems and performing any incorporated method. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A cover assembly for use with a first window and an opposing second window, the cover assembly comprising:

a first slide fastener assembly coupled to the first window and comprising a first track;

a second slide fastener assembly coupled to the second window and comprising a second track;

a cover coupled to the second slide fastener assembly; and a cord connector coupled to the first slide fastener assembly and to the second slide fastener assembly, wherein, as the first slide fastener assembly travels along the first track, the cord connector is configured to move the second slide fastener assembly along the second track such that the cover moves between a first position and a second position relative to the second window.

2. The cover assembly of claim 1 wherein the first slide fastener assembly comprises a first fastener and a second fastener which are coupled to the first track and configured to adjacently travel along the first track to maintain the first track in a fastened position.

3. The cover assembly of claim 2 wherein the first fastener comprises a first zipper and the second fastener comprises a second zipper.

4. The cover assembly of claim 1 wherein the first slide fastener assembly comprises a first zipper, a second zipper, and a fastener coupled to the first zipper and the second zipper.

5. The cover assembly of claim 1 wherein the cover, in the first position, is configured to at least partially overlay the second window.

6. The cover assembly of claim 1 wherein the cover, in the second position, is configured to at least partially expose the second window.

7. The cover assembly of claim 1 wherein the cord connector is removably coupled to the first slide fastener assembly.

8. The cover assembly of claim 1 further comprising a reel mechanism coupled to at least one of the second slide fastener assembly and the connector.

9. The cover assembly of claim 1 further comprising a third slide fastener assembly coupled to the first window and a fourth slide fastener assembly coupled to the second window.

10. A cover assembly for use with a tent having a first window and a fly having a second window disposed adjacent to the first window, the cover assembly comprising:

a first slide fastener assembly coupled to the first window and positioned inside the tent, the first slide fastener comprising a first track;

a second slide fastener assembly coupled to the second window and positioned outside of the tent, the second slide fastener comprising a second track;

a third slide fastener assembly coupled to the first window;

a fourth slide fastener assembly coupled to the second window;

a cover coupled to the second slide fastener assembly;

a connector coupled to the first slide fastener assembly and to the second slide fastener assembly, wherein, as the first slide fastener assembly travels along the first track, the connector is configured to move the second slide fastener assembly along the second track such that the cover moves between a first position and a second position relative to the second window; and a cover storage area coupled to the fly and configured to receive the cover when the cover is in the second position.

11. The cover assembly of claim 10 further comprising a cross connector coupled to the first slide fastener assembly and the third slide fastener assembly.

12. The cover assembly of claim 10 wherein the connector includes a first end, a second end, and an adjustable body located between the first end and the second end.

13. The cover assembly of claim 10 further comprising a storage seal coupled to the cover storage area.

14. A cover assembly for use with a tent having a first window and a fly having a second window disposed adjacent to the first window, the cover assembly comprising:

a first slide fastener assembly coupled to the first window and positioned inside the tent, the first slide fastener comprising a first track;

a second slide fastener assembly coupled to the second window and positioned outside of the tent, the second slide fastener comprising a second track;

a third slide fastener assembly coupled to the first window and positioned inside the tent;

a fourth slide fastener assembly coupled to the second window and positioned outside of the tent;

a cover coupled to the second slide fastener assembly and to the fourth slide fastener assembly;

a connector coupled to the first slide fastener assembly and to the second slide fastener assembly, wherein, as the first slide fastener assembly travels along the first track, the connector is configured to move the second slide fastener assembly along the second track such that the cover moves between a first position and a second position relative to the second window.

* * * * *